US008669904B2

(12) United States Patent
Choi et al.

(10) Patent No.: US 8,669,904 B2
(45) Date of Patent: Mar. 11, 2014

(54) NEAR-FIELD ANTENNA

(75) Inventors: Won Kyu Choi, Daejeon-si (KR); Jae Young Jung, Daejeon-si (KR); Jong Suk Chae, Daejeon-si (KR)

(73) Assignee: Electronics & Telecommunications Research Institute, Daejeon-si (KR)

( * ) Notice: Subject to any disclaimer, the term of this patent is extended or adjusted under 35 U.S.C. 154(b) by 175 days.

(21) Appl. No.: 13/292,842

(22) Filed: Nov. 9, 2011

(65) Prior Publication Data

US 2012/0139795 A1 Jun. 7, 2012

(30) Foreign Application Priority Data

Dec. 3, 2010 (KR) ..... 10-2010-0122772

(51) Int. Cl.
*H01Q 1/38* (2006.01)

(52) U.S. Cl.
USPC ..... 343/700 MS; 343/746; 343/767; 343/768; 343/769

(58) Field of Classification Search
USPC ..... 343/700 MS
See application file for complete search history.

(56) References Cited

U.S. PATENT DOCUMENTS

| | | | | |
|---|---|---|---|---|
| 6,384,793 | B2 * | 5/2002 | Scordilis | 343/767 |
| 7,557,757 | B2 * | 7/2009 | Deavours et al. | 343/700 MS |
| 2003/0151556 | A1 | 8/2003 | Cohen | |
| 2008/0231532 | A1 * | 9/2008 | Rao et al. | 343/770 |
| 2010/0327068 | A1 * | 12/2010 | Chen et al. | 235/492 |

FOREIGN PATENT DOCUMENTS

KR 1020100015119 2/2010

* cited by examiner

*Primary Examiner* — Jerome Jackson, Jr.
*Assistant Examiner* — Andrea Lindgren Baltzell
(74) *Attorney, Agent, or Firm* — Nelson Mullins Riley & Scarborough LLP

(57) ABSTRACT

The present invention relates to a near-field antenna. In an aspect, the near-field antenna may include a dielectric layer, a ground plane formed on one side of the dielectric layer, a plurality of U-shaped slots periodically disposed in the ground plane for radiation, and a microstrip line provided on the other side of the dielectric layer for power feeding. In another aspect, the near-field antenna may include a dielectric layer, a ground plane formed on one side of the dielectric layer, a plurality of U-shaped slots periodically disposed in the ground plane for radiation, and a microstrip line configured to have a plurality of U-shaped slots diverged on the other side of the dielectric layer in parallel for power feeding, have the plurality of U-shaped slots periodically disposed in series in respective diverged lines, and have an end shorted to form standing waves.

11 Claims, 6 Drawing Sheets

NEAR-FIELD ANTENNA

Priority to Korean patent application number 10-2010-0122772 filed on Dec. 3, 2010, the entire disclosure of which is incorporated by reference herein, is claimed.

BACKGROUND OF THE INVENTION

1. Field of the Invention

The present invention relates to a near-field antenna and, more particularly, to a near-field antenna for item-level tagging, which is capable of recognizing a large quantity of approaching tags in a bundle using a near field.

2. Discussion of the Related Art

An Ultra High Frequency (UHF) band Radio frequency IDentification (RFID) application field is expanding from the tagging of a pallet, case, or box unit to item-level tagging. In general, for item-level tagging, the RFID technique of a High Frequency (HF) band was preferred, but has problems, such as the size and price of a tag, the tagging distance, the data processing speed, and compatibility with the existing UHF band RFID standard.

Unlike the RFID technique of an HF band using a magnetic coupling method, the RFID technique of a UHF band using a back-scattering method of electromagnetic waves is advantageous in that it has a relatively long tagging distance and thus has been widely used in the distribution of the pallet unit and the materials management of the box unit.

However, the RFID technique of a UHF band shows performance that the tagging ratio sharply drops in the item-level tagging (ILT) application field in which a large number of items are clustered together because of the scattering, interference, etc. of electromagnetic waves. In order to overcome the shortcoming of the UHF band RFID technique in the item-level tagging, active research is being carried out on an RFID antenna technique using a near field in the UHF band.

If a UHF band far-field is used for the tagging of the pallet or box unit and a UHF band near field is used for a large amount of item-level tagging, not only the tagging of the pallet or box unit, but also the item-level tagging is possible using the UHF band RFID technique.

Unlike the HF band RFID technique using the magnetic coupling method, a technique using a UHF band near field is advantageous in that the magnetic coupling method and the electric coupling method can be properly selected according to an item to which a tag is attached and service environments.

However, the UHF band near-field RFID reader antenna has to be designed based on a different concept from that of the existing far-field antenna. That is, the UHF band near-field RFID reader antenna has to be designed by taking an item-level tagging environment, a tag attachment location, and a required near-field distribution into consideration. Furthermore, since near-field communication is performed according to the coupling method between a reader antenna and a tag antenna, the structure of the tag antenna has to be taken into consideration in the design of the reader antenna.

A conventional technique pertinent to the UHF band RFID reader antenna basically includes a far-field application of a microstrip patch antenna form. Furthermore, an RFID smart shelf application is chiefly implemented using a loop antenna in the HF band.

In general, the RFID smart shelf may have a variety of sizes and shapes according to the application field. Accordingly, the size of the reader antenna mounted on the smart shelf has to be able to be easily changed according to a change of the size and shape of the shelf according to application. In other words, the reader antenna mounted on the shelf has to be able to be easily extended and reduced according to a change of the shelf structure (i.e., size and shape).

That is, the reader antenna for the RFID smart shelf has to have a uniform field distribution without a fading zone so that a number of items on the shelf can be stably recognized and to have a structure in which the antenna size can be easily extended and reduced according to a change of the shelf structure.

However, there are a lot of difficulties in designing an RFID reader antenna having the above characteristics using a conventional HF band antenna technique and a conventional antenna technique of a UHF band.

SUMMARY OF THE INVENTION

Accordingly, the present invention has been made keeping in mind the above problems occurring in the prior art, and an object of the present invention is to provide a near-field antenna using the field of a near-field region for item-level tagging from among several application fields related to UHF band RFID.

Another object of the present invention is to provide a near-field antenna that may be used as an RFID reader antenna having a series power feeding structure capable of efficiently power feeding a radiation structure having a plurality of U-shaped slots.

The objects of the present invention may be understood from the following description and evidently understood through embodiments of the present invention. It can also be seen that the objects and advantages of the present invention may be readily realized by means written in the claims and a combination thereof.

A near-field antenna according to an aspect of the present invention includes a dielectric layer, a ground plane formed on one side of the dielectric layer, a plurality of U-shaped slots periodically disposed in the ground plane for radiation, and a microstrip line provided on the other side of the dielectric layer for power feeding.

The microstrip line may have the end shorted and configured to form standing waves. In order to short the end of the microstrip line, the microstrip line and the ground plane may be connected through a via hole having an internal surface plated with metal.

One side of each of the U-shaped slots may be periodically placed for every location shifted from the end of the microstrip line by a $\lambda/2$ interval. The sides of the U-shaped slot may have a phase difference of 180° in the current distribution.

The microstrip line disposed between the sides of the U-shaped slot may have a curved shape. The coupling area of a location overlapped with the microstrip line of the plurality of U-shaped slots with the dielectric layer interposed therebetween.

A near-field antenna according to another aspect of the present invention includes a dielectric layer, a ground plane formed on one side of the dielectric layer, a plurality of U-shaped slots periodically disposed in the ground plane for radiation, and a microstrip line configured to have a plurality of U-shaped slots diverged on the other side of the dielectric layer in parallel for power feeding, have the plurality of U-shaped slots periodically disposed in series in respective diverged lines, and have an end shorted to form standing waves.

In order to short the end of the microstrip line, the microstrip line and the ground plane may be connected through a via hole having an internal surface plated with metal.

One side of each of the U-shaped slots may be periodically placed for every location shifted from the end of the microstrip line by a λ/2 interval. The sides of the U-shaped slot may have a phase difference of 180° in the current distribution.

The microstrip line disposed between the sides of the U-shaped slot may have a curved shape. The coupling area of a location overlapped with the microstrip line of the plurality of U-shaped slots with the dielectric layer interposed between the coupling area and the microstrip line may be sequentially increased.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE EMBODIMENTS

The present invention will become more evident from a description of embodiments of the present invention in conjunction with the accompanying drawings, and thus a person having ordinary skill in the art to which the present invention pertains may readily implement the technical spirit of the present invention. In describing the present invention, a detailed description of the known functions and constructions will be omitted if it is deemed to make the gist of the present invention unnecessarily vague. The embodiments of the present invention will now be described in detail with reference to the accompanying drawings.

Figure 1:
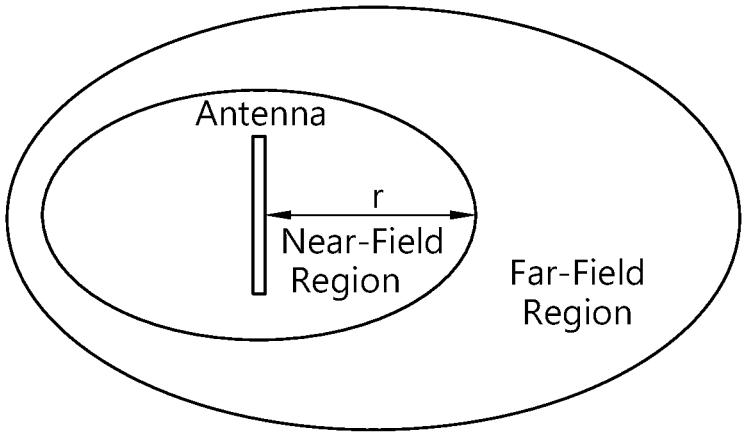
FIG. 1 is a diagram illustrating the near-field region and the far-field region of an antenna.

FIG. 1 is a diagram illustrating the near-field region and the far-field region of an antenna. As shown in FIG. 1, the near-field region is a region where electric field energy or magnetic energy is concentrated. In the near-field region, communication between an RFID reader and a tag is performed according to the electric coupling method or the magnetic coupling method. The far-field region is a region where electromagnetic waves in which an electric field and a magnetic field are strongly coupled exist. In the far-field region, communication between an RFID reader and a tag is performed through the propagation of electromagnetic waves.

Accordingly, the design concept of an RFID tag and a reader antenna has to be changed according to at which area an RFID application is performed. Furthermore, the RFID application may include application to the far field, application to the near field, and a proper combination of application to the far field and application to the near field.

In FIG. 1, 'r' is the center of the antenna and is the distance approximately indicating the boundary of the near-field region and the far-field region. In terms of a common antenna, $r=2D^2/\lambda$. In terms of a small-sized electrical antenna, $r=\lambda/2\pi$. Here, 'D' is a maximum size of the antenna, and 'λ' is the wavelength of a center frequency.

The RFID reader antenna according to an embodiment of the present invention communicates with a tag through the electric coupling method chiefly in the near field.

Figure 2:
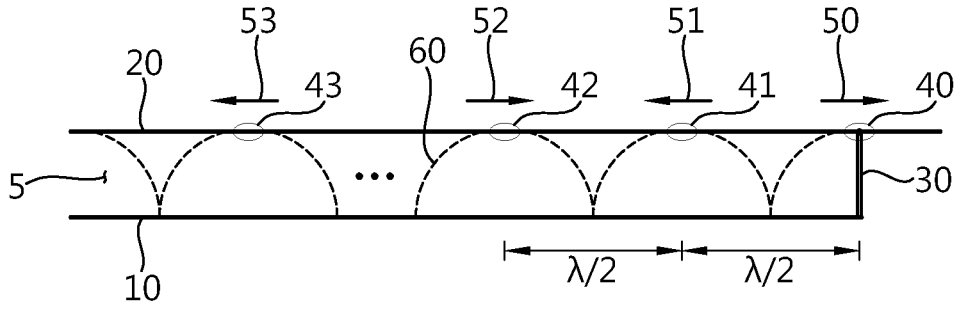
FIG. 2 is a diagram showing a current distribution of a standing wave form which is formed on a microstrip line having an end shorted.

FIG. 2 is a diagram showing a current distribution of a standing wave form which is formed on a microstrip line having an end shorted. As shown in FIG. 2, the end of the microstrip line 10 is shorted. When power is supplied to the microstrip line 10, a traveling wave and a reflected wave are combined together, thus forming standing waves 60 on the microstrip line 10. A distribution of the standing waves 60 shown in FIG. 2 is a current distribution.

In order to short the microstrip line 10 and a ground plane 20, the end of the microstrip line 10 and the ground plane 20 are connected using a via hole 30. The via hole 30 connects the microstrip line 10 and the ground plane 20 through a dielectric layer 5. The internal surface of the via hole 30 is plated with metal.

The current distribution 60 is a maximum at a portion where the microstrip line 10 and the ground plane 20 are shorted by the via hole 30. That is, since the current standing waves 60 are formed between the microstrip line 10 and the ground plane 20, the current distribution 60 becomes the maximum at the end point of the microstrip line 10 at which the via hole 30 is placed. Points 40, 41, 42, 43, . . . , at each of which the current distribution 60 is the maximum periodically appear whenever the current distribution is shifted from the end point by a λ/2 interval.

Furthermore, a current phase 50 at the first point 40 where the current distribution is the maximum and a current phase 51 at another maximum point 41 shifted at the λ/2 interval have a difference of 180°. Furthermore, a current phase 52 at further another maximum point 42 shifted from the maximum point 41 at the λ/2 interval and the current phase 51 at the maximum point 41 also have a difference of 180°.

That is, the current distribution 60 becomes a maximum at the point 40 at which the microstrip line 10 is shorted by the via hole 30, and the points 41, 42, 43, . . . , at which the current distribution 60 becomes a maximum periodically appear whenever the current distribution 60 is shifted from the short point 40 at the λ/2 interval. Furthermore, the current distributions at the points at which the current distribution is a maximum have repetitive phase differences 50, 51, 52, 53, . . . , of 180°.

If UHF band resonant slots formed on the ground plane 20 are excited using the microstrip line 10 having the end shorted and the current distribution characteristic formed on the ground plane 20, an antenna having a uniform near-field electric field distribution can be implemented. The RFID reader antenna according to an embodiment of the present invention implements a near-field antenna in which a plurality of U-shaped slots is periodically formed on the ground plane 20 of the microstrip line 10 having the above current distribution and the near-field electric field distribution has an almost uniform characteristic.

If a concept that a plurality of repetitive slots is supplied with power in series using the single microstrip line 10 is used, a near-field antenna suitable for a variety of RFID smart shelf applications can be easily designed. That is, an antenna can be easily extended and reduced.

Figure 3:
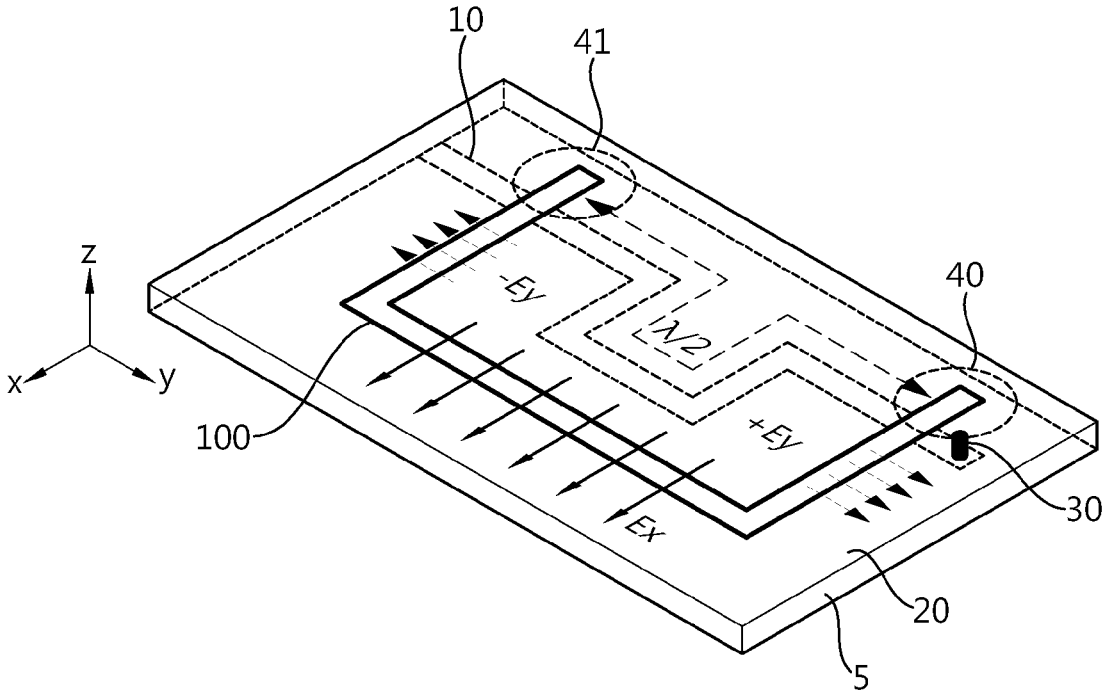
FIG. 3 is a perspective view of the single radiation element of a near-field antenna according to an embodiment of the present invention.

FIG. 3 is a perspective view of the single radiation element of a near-field antenna according to an embodiment of the present invention. As shown in FIG. 3, the near-field antenna according to the embodiment of the present invention includes the single dielectric layer 5. The microstrip line 10 for power feeding the radiation element is formed at the bottom of the dielectric layer 5. The ground plane 20 is formed on the top of the dielectric layer 5. A U-shaped slot 100 resonating at a specific frequency is formed in the ground plane 20 for the radiation of an electric field.

A current distribution of a standing wave form, such as that shown in FIG. 2, is formed in the microstrip line 10 having the end shorted by the via hole 30. The current distribution becomes a maximum at the end point 40 at which the microstrip line 10 is shorted by the via hole 30. Furthermore, the current distribution becomes a maximum at the point 41 shifted from the shorted end point 40 by a λ/2 interval. Furthermore, the current distributions at the two points 40 and 41 where the current distribution is the maximum have a phase difference of 180°.

The U-shaped radiation slot 100, such as that shown in FIG. 3, is disposed at the two points 40 and 41 where the current distributions have a maximum and opposite phases (i.e., a phase difference of 180°) as described above. Since the phases of the current distributions at the two points 40 and 41 are opposite to each other, electric fields excited by the radiation slot 100 have opposite directions.

That is, if the direction of an electric field excited from the end point 40 of the microstrip line 10, having the end shorted by the via hole 30, to one side of the U-shaped slot 100 is a +y direction (+Ey), the direction of an electric field excited from the point 41 at which a current distribution is a maximum to the other side of the U-shaped slot 100 is a −y direction (−Ey). Accordingly, a strong electric field component (i.e., an Ex component of the x direction) is excited from the other side of the U-shaped slot by means of the two electric fields +Ey and −Ey of the different directions as described above. The Ex component becomes a main radiation component of the U-shaped slot 100 (i.e., the single radiation element).

In the embodiment of the present invention, in order to maintain the microstrip line 10 between one side and the other side of the U-shaped slot 100 at the λ/2 interval, the microstrip line 10 is illustrated to be curved in the form of '⊏'. However, the microstrip line 10 may have structures of various forms.

Figure 4:
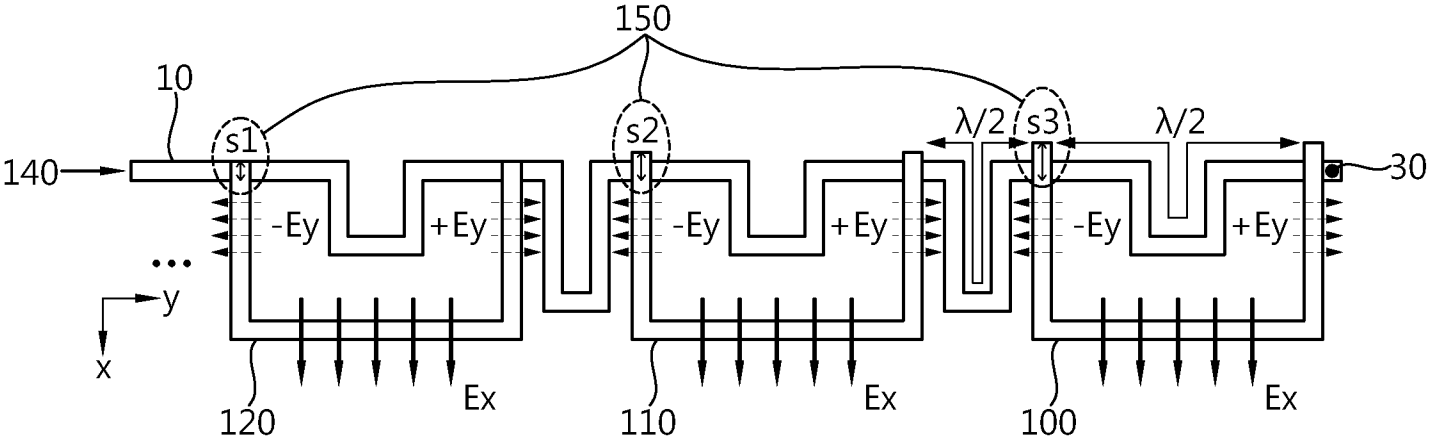
FIG. 4 is a front view of the near-field antenna in which U-shaped slot radiation elements are extended and arranged in the y direction.

FIG. 4 is a front view of the near-field antenna in which the U-shaped slot radiation elements are extended and arranged in the y direction. As described above with reference to FIG. 2, when power is supplied to the microstrip line 10 having the end shorted by the via hole 30, current standing waves are formed on the microstrip line 10. That is, a maximum point and a minimum point of a current distribution repeatedly appear on the microstrip line 10 at the interval of λ/2. In the embodiment of the present invention, the U-shaped radiation slots 100, 110, and 120 can be strongly excited because the sides of the plurality of U-shaped radiation slots 100, 110, and 120 are disposed at respective points at each of which the current distribution is a maximum on the microstrip line 10.

In the near-field antenna of FIG. 4, a first maximum current distribution appears at the portion shorted by the via hole 30, and a second maximum distribution appears at a portion shifted from the first maximum current distribution by the λ/2 interval. In this manner, the maximum current distribution point is repeatedly generated at the interval of λ/2. A near-field antenna that may be used as an RFID reader antenna according to an embodiment of the present invention has the two sides of each of the plurality of U-shaped radiation slots 100, 110, and 120 disposed at the respective points at each of which the current distribution is a maximum and thus radiates an electric field.

Furthermore, the phases of the maximum current distributions formed at the interval of λ/2 are reversed with a phase difference of 180°. Accordingly, electric fields excited by the respective current distributions have opposite directions (−Ey and +Ey directions). The two electric field components −Ey and +Ey excited in the opposite directions on both sides of each of the U-shaped radiation slots 100, 110, and 120 become a source to excite a strong electric field from the center of the U-shaped slot to another direction Ex.

The strong electric field Ex formed as described above becomes a major radiation component of a single U-shaped radiation element. Furthermore, the microstrip line 10 having the current standing waves formed thereon may have a specific shape in order to maintain the physical distance between the U-shaped radiation slots 100, 110, and 120 (the distance between the slots 100, 110, and 120) and the distance between the two ends of each of the U-shaped radiation slots 100, 110, and 120 at the interval of λ/2.

If the U-shaped slots are periodically disposed at the maximum current distribution points formed on the microstrip line 10 in the y direction as shown in FIG. 4 in this manner, a near-field antenna structure that can be easily extended and reduced in the y direction can be obtained.

Furthermore, when the U-shaped slots are arranged as described above, the amount of the electric field excited to the U-shaped slots is gradually decreased because of a tapering effect. In other words, a strong electric field is excited to the U-shaped slot 120 placed close to a power feeding port 140, and a relatively weak electric field is excited to the U-shaped slot 100 relatively far from the power feeding port 140, thereby not obtaining a uniform near field electric field. In order to solve the above problem, in an embodiment of the present invention, a coupling area 150 (s1, s2, and s3) in which the electric field is excited from the microstrip line 10 to the U-shaped slots 100, 110, and 120 are employed.

That is, when the power feeding port 140 of the microstrip line 10 supplies power to the plurality of U-shaped slots in series, the amount of electric coupling excited while the plurality of slots is sequentially supplied with power (e.g., the slot 120→the slot 110→the slot 100) is sequentially decreased. The tapering effect can be solved by sequentially increasing the coupling area 150 (s1, s2, and s3) at which the microstrip line 10 and the U-shaped slots are coupled. In other words, the coupling area 150 (s1<s2<s3) is sequentially increased, so that a uniform electric field is formed in the near field.

Figure 5:
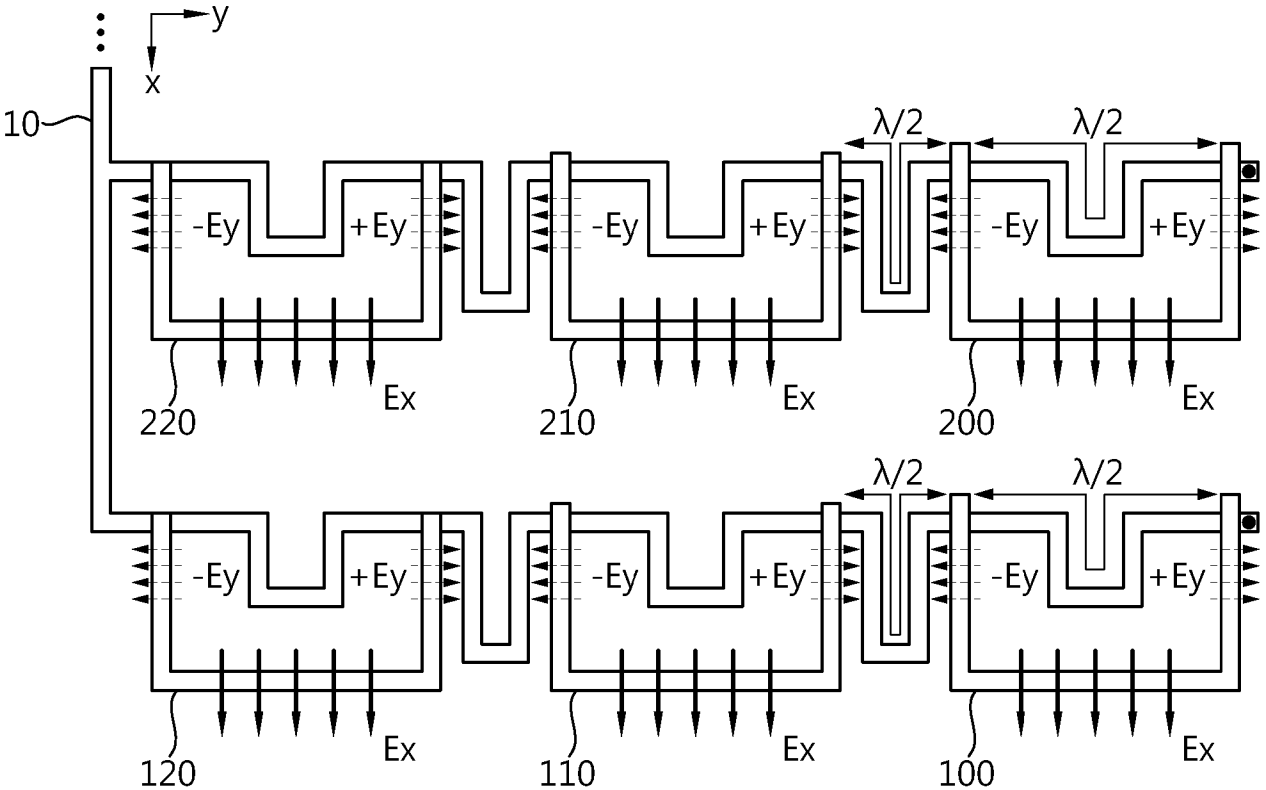
FIG. 5 is a front view of the near-field antenna in which the U-shaped slot radiation elements arranged as shown in FIG. 4 are extended and arranged in the x direction.

FIG. 5 is a front view of the near-field antenna in which the U-shaped slot radiation elements arranged as shown in FIG. 4 are extended and arranged in the x direction. In FIG. 4, the antenna can be extended and reduced in the y direction. FIG. 5 shows an example in which the antenna can be extended and reduced in the x direction using a series power feeding method or a parallel power feeding method.

As described above, the microstrip line 10 for power feeding and the U-shaped slots for radiation are coupled together using the electromagnetic coupling method. Accordingly, if a plurality of U-shaped slots 100, 110, 120, 200, 210, and 220 is properly arranged on the microstrip line 10 of a specific structure, the size of the near-field antenna can be freely extended and reduced.

Figure 6:
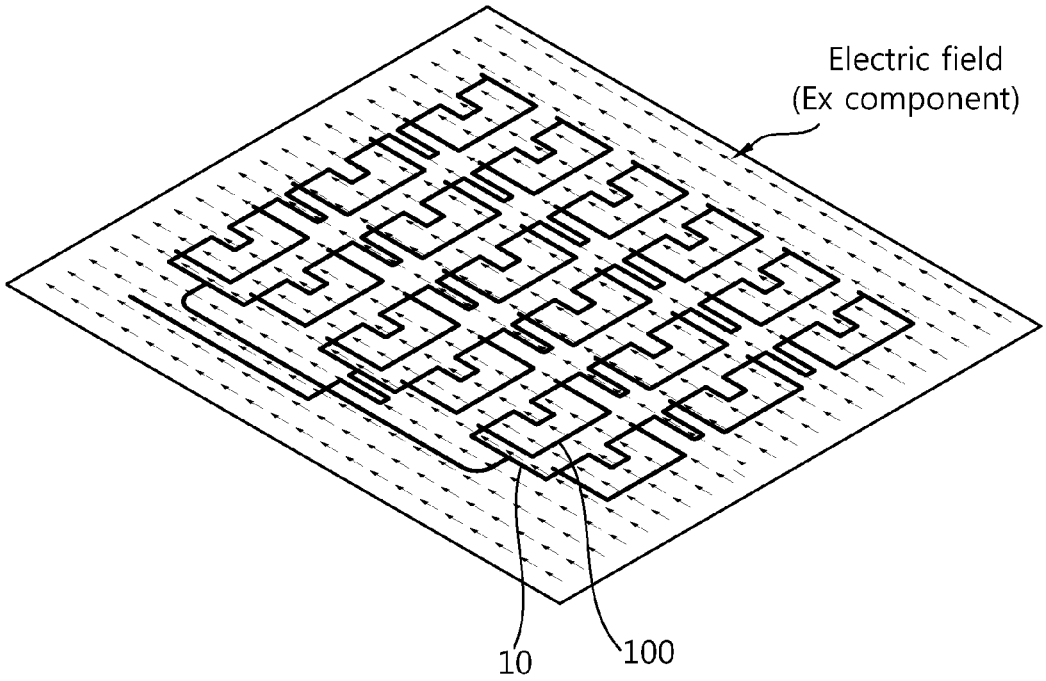
FIG. 6 is a diagram showing an embodiment and a distribution of electric fields of the near-field antenna according to an embodiment of the present invention.

FIG. 6 is a diagram showing an embodiment and a distribution of electric fields of the near-field antenna according to an embodiment of the present invention. The near-field antenna that may be used as an RFID reader antenna shown in FIG. 6 is an arrangement type near-field antenna in which the three U-shaped slots 100 are arranged in the y direction and the six U-shaped slots 100 are arranged in the x direction. An arrow in FIG. 6 indicates an electric field component Ex in the x direction which is radiated from the near-field antenna.

From FIG. 6, it can be seen that the electric field component of the x direction is almost uniformly formed in the entire region of the near-field antenna.

The near-field antenna that may be used as the RFID reader antenna according to the embodiment of the present invention as described above may be used in bookshelves for the management of books, conveyer belts for the management of postal logistics, and RFID shelves for the management of various items in drugstores and large retail stores, such as RFID services using the near field for item-level tagging. The services may be used to recognize all various and a large number of items, existing at a short range in the reader antenna.

Furthermore, the near-field antenna that may be used as the RFID reader antenna according to the embodiment of the present invention has a uniform field distribution in a wide tagging area without a fading zone, unlike that the fading zone is removed using a number of RFID reader antennas when a large number of items exist in the wide area. Accordingly, the efficiency of a system can be increased.

The near-field antenna according to the present invention may be used as an RFID reader antenna suitable for an RFID smart shelf application and implemented using an ultra-thin structure using a dielectric substrate of a single layer. Accordingly, there are advantages in that the near-field antenna can be easily built in the smart shelf and a fading zone or a dead zone is not generated on the smart shelf because the plurality of U-shaped slots is periodically disposed. Furthermore, in the near-field antenna according to the present invention, the locations of the U-shaped slots and the number of U-shaped slots, having a radiation structure, can be increased or decreased according to the size and structure of a smart shelf. Accordingly, the antenna can be easily extended and reduced and lots of problems that may occur in an RFID smart shelf application can be solved.

While the invention has been shown and described with respect to the preferred embodiments, it will be understood by those skilled in the art that various changes and modifications may be made without departing from the spirit and scope of the invention as defined in the following claims.

What is claimed is:

1. A near-field antenna, comprising a dielectric layer;

a ground plane formed on one side of the dielectric layer;

a plurality of U-shaped slots periodically disposed in the ground plane for radiation; and a microstrip line provided on the other side of the dielectric layer for power feeding, wherein one side of each of the plurality of U-shaped slots is periodically placed for every location shifted from the end of the microstrip line by a $\lambda/2$ interval.

2. The near-field antenna of claim 1, wherein the micro strip line has an end shorted and configured to form standing waves.

3. The near-field antenna of claim 2, wherein in order to short the end of the microstrip line, the microstrip line and the ground plane are connected through a via hole having an internal surface plated with metal.

4. The near-field antenna of claim 1, wherein the sides of the U-shaped slot have a phase difference of 180° in a current distribution.

5. The near-field antenna of claim 1, wherein the microstrip line disposed between the sides of the U-shaped slot has a curved shape.

6. The near-field antenna of claim 1, wherein a coupling area overlapped with the microstrip line of the plurality of U-shaped slots with the dielectric layer interposed between the coupling area and the microstrip line is sequentially increased.

7. A near-field antenna, comprising a dielectric layer;

a ground plane formed on one side of the dielectric layer;

a plurality of U-shaped slots periodically disposed in the ground plane for radiation; and a microstrip line configured to have a plurality of U-shaped slots diverged on the other side of the dielectric layer in parallel for power feeding, have the plurality of U-shaped slots periodically disposed in series in respective diverged lines, and have an end shorted to form standing waves wherein one side of each of the plurality of U-shaped slots is periodically placed for every location shifted from the end of the microstrip line by a $\lambda/2$ interval.

8. The near-field antenna of claim 7, wherein in order to short the end of the microstrip line, the microstrip line and the ground plane are connected through a via hole having an internal surface plated with metal.

9. The near-field antenna of claim 7, wherein the sides of the U-shaped slot have a phase difference of 180° in a current distribution.

10. The near-field antenna of claim 7, wherein the microstrip line disposed between the sides of the U-shaped slot has a curved shape.

11. The near-field antenna of claim 7, wherein a coupling area of a location overlapped with the microstrip line of the plurality of U-shaped slots with the dielectric layer interposed between the coupling area and the microstrip line is sequentially increased.

* * * * *